US007681262B2

(12) United States Patent
Weedling et al.

(10) Patent No.: US 7,681,262 B2
(45) **Date of Patent: *Mar. 23, 2010**

(54) PATIENT INCLINE DEVICE HAVING CENTERLINE SPINAL SUPPORT

(76) Inventors: Robert E. Weedling, 1055 Del Harbour Dr., Delray Beach, FL (US) 33483; James E. Weedling, 5456 Northwood Dr., Center Valley, PA (US) 18034

( * ) Notice: Subject to any disclaimer, the term of this patent is extended or adjusted under 35 U.S.C. 154(b) by 0 days.

This patent is subject to a terminal disclaimer.

(21) Appl. No.: 12/316,685

(22) Filed: Dec. 16, 2008

(65) Prior Publication Data

US 2009/0100596 A1 Apr. 23, 2009

Related U.S. Application Data

(63) Continuation-in-part of application No. 11/732,184, filed on Apr. 3, 2007, now Pat. No. 7,467,431.

(60) Provisional application No. 60/855,874, filed on Nov. 1, 2006, provisional application No. 60/855,974, filed on Nov. 1, 2006.

(51) Int. Cl.
*A47C 27/10* (2006.01)
*A61G 7/14* (2006.01)

(52) U.S. Cl. ..... 5/633; 5/655.3; 5/634

(58) Field of Classification Search ..... 5/81.1 HS, 5/715, 731, 733, 640, 644, 645, 646, 652, 5/655.3, 657, 630
See application file for complete search history.

(56) References Cited

U.S. PATENT DOCUMENTS 4,685,163 A * 8/1987 Quillen et al. ..... 5/710
4,977,629 A * 12/1990 Jones ..... 5/632
5,279,310 A 1/1994 Hsein
5,479,667 A * 1/1996 Nelson et al. ..... 5/636
5,987,675 A * 11/1999 Kim ..... 5/632
6,223,368 B1 * 5/2001 Anslin ..... 5/630
6,292,964 B1 9/2001 Rose et al.
6,848,137 B1 * 2/2005 Barnes ..... 5/710
7,127,758 B2 * 10/2006 Gabbay ..... 5/633

(Continued)

*Primary Examiner*—Michael Trettel
(74) *Attorney, Agent, or Firm*—Drinker Biddle & Reath LLP

(57) ABSTRACT

A patient incline device includes a base member, an inflatable incline ramp located on an upper surface of the base member, an incline ramp adapted to support a patient such that the patient's upper torso is elevated with respect to the base member, an inflatable head support pillow and a wedge-shaped inflatable spinal support air chamber located on the incline ramp and angling upward in a direction away from the incline ramp, and aligned with a centerline of the incline ramp, wherein the peak end of the wedge extends to about the region of the patient's lumbar curve so that the buttocks are not raised upon inflation.

The wedge-shaped spinal support chamber may also include a pop-up air chamber having internal air vents to the spinal support chamber such that when the spinal support chamber inflates, the pop-up chamber rises as pressure accumulates and lifts a thoracic curve portion of the patient's spine.

An accessory lift device is provided for use in situations where raising the patient's buttocks and pelvis is wanted. The accessory is an inflatable air chamber having side lobes adapted to lie along each lateral side of the inflatable pad base and a seat portion that crosses transversely over the inflatable base pad beneath the patient's buttocks.

10 Claims, 15 Drawing Sheets

U.S. PATENT DOCUMENTS 7,210,176 B2 * 5/2007 Weedling et al. ..... 5/81.1 R
7,310,840 B2 * 12/2007 Rubio ..... 5/636
7,467,431 B2 * 12/2008 Weedling et al. ..... 5/633

* cited by examiner

PATIENT INCLINE DEVICE HAVING CENTERLINE SPINAL SUPPORT

CROSS-REFERENCE TO RELATED APPLICATIONS

This application is a continuation-in-part of U.S. application Ser. No. 11,732,184 filed Apr. 3, 2007 and issued as U.S. Pat. No. 7,467,431, which claims priority of U.S. Provisional Application No. 60/855,874, filed Nov. 1, 2006 and U.S. Provisional Application No. 60/855,974 filed Nov. 1, 2006. Priority is claimed herein for the subject matter disclosed in those earlier filed applications.

FIELD OF THE INVENTION

The present invention relates generally to patient incline devices and, more particularly, to a patient incline device adapted for use with obese patients.

BACKGROUND OF THE INVENTION

Incline devices for elevating the head and upper torso of a patient with respect to the patient's legs are known. The inclined position assists breathing and allows the patient more freedom of movement to observe and to better interact with surrounding objects than in a flat, supine, position. One specialized use for a patient incline device is to place the head and neck of the patient in better position for an intubation procedure in which an endotracheal tube is inserted into the patient's airway. The desired position for the patient being intubated, in which the trachea is opened, is sometimes referred to as the "sniffing" position.

As discussed in U.S. Patent Publication No. 2005/0193496, it is also known to use incline devices to elevate the head of patients for whom laying in a supine condition for extended periods of time would be unhealthy. This is particularly true for morbidly obese patients because excess fat in the chest wall area compresses the lungs, making it more difficult for the patient to breath. Such respiratory difficulty can aggravate other conditions such as Chronic Obstructive Pulmonary Disease (COPD) and Congestive Heart Failure (CHF).

The work of breathing ("WOB") includes an elastic component that is primarily influenced by the inward recoil of the lungs and the outward recoil of the chest wall. Elastic work during breathing is performed primarily during inspiration as the lungs and chest wall are expanded creating a pressure gradient to move gas into the lungs. Factors that contribute to the elastic WOB include the stiffness (i.e., a measure of compliance) of the pulmonary tissue, recoil pressure of the chest wall, and resistance offered by the abdominal cavity.

When respiratory excursion (i.e., the outward movement of the chest wall during inspiration) is impaired by morbid obesity, skeletal or pulmonary disease, pregnancy or severe burns to the chest wall, the intrathoracic volume is compressed and chest wall compliance is impaired. This dramatically increases the WOB that is required to maintain functional residual capacity and an adequate tidal volume and can result in ventilation-perfusion (V/Q) mismatch, lung collapse, and hypoventilation. Also, mask ventilation tends to be difficult because of low chest wall compliance, particularly for morbidly obese patients as a result of increased intra-abdominal pressure caused by large abdominal fat accumulations.

When a patient is inclined using a conventional incline device having a sloped incline ramp that contacts the head and upper torso of the patient, the spine of the patient may not be fully supported along its length such that an upper portion of the spine curves (i.e., analogously to a standing person exhibiting a crooked or "hunched" posture). Such curvature of the upper spine tends to contract the chest wall area of the patient. Thus, the respiratory benefits associated with inclining a patient, particularly an obese patient, are not fully realized because of undesirable misalignment of the spine. In addition, the condition of sleep apnea may be aggravated for patient's that are inclined for extended periods of time with the spine in an unsupported condition.

SUMMARY OF THE INVENTION

According to the present invention, a patient incline device includes an incline ramp and a spinal support. The incline ramp elevates an upper portion of the patient, including the head, with respect to the lower portion of the patient including the legs. The spinal support is adapted to contact the back of the patient whose head is elevated by the incline ramp, such that a central portion of the back adjacent the spine is supported and lifted with respect to the sides and arms of the patient. The incline device may also include a head support pillow.

The support of the spine provided by the spinal support promotes spinal alignment by limiting curvature of the spine. The lifting of the spine with respect to the outwardly located sides and arms of the patient redistributes patient body mass away from the centerline of the patient into spaces defined along opposite sides of the spinal support. This redistribution of patient mass desirably results in outward lateral extension of the chest wall, thereby promoting pulmonary mechanics.

According to one embodiment, both the incline ramp and the spinal support of the incline device are inflatable. The device may include an inlet connected to the incline ramp for inflating the incline ramp and holes between the incline ramp and the spinal support for inflating the spinal support. Alternatively, the incline ramp and spinal support may define separate chambers and the device includes an inlet for each of the incline ramp and the spinal support. According to one embodiment, the device also includes a separate head support pillow having an inlet. According to one embodiment, the incline ramp is static (i.e., non-inflating) and comprises a cushioning material in an interior of the incline ramp.

Preferably, the incline ramp and spinal support are located on an upper surface of an underlying support. The incline ramp and spinal support may be removably attached to the underlying support or, alternatively, may be secured to the underlying support. According to one embodiment, the device includes a base member having an upper surface on which the incline ramp and spinal support are located. The base member may be adapted for attaching the base member to an underlying support member. According to one embodiment, the device also includes a support pad on which the base member is located. The support pad may be adapted for attaching the support pad to an underlying support member.

According to one embodiment, the patient incline device comprises a transfer device including an inflatable plenum having holes in a bottom sheet to create a load-bearing cushion of discharging air beneath the transfer device to facilitate sliding movement on an underlying surface. The transfer device preferably includes side pull straps for applying pulling force to the transfer device.

The support of the patient's back provided by the spinal support of the present invention also makes the clavicle areas and the subclavian vessels more prominent. This facilitates easier central venous access, thereby obviating the need for traditional forms of patient positioning using hospital linens or towels. According to one embodiment of the invention, the incline device also includes clavicle supports located on opposite sides of the incline ramp. The clavicle supports may define separate interiors for independent inflation with respect to the incline ramp or, alternatively, may define integral extensions of the interior of the incline ramp for common inflation.

According to one embodiment, a pulsating pressure system is provided for delivering air pulses to one or more inflatable chambers of the patient incline device to promote skin integrity and patient comfort. According to one embodiment, the pulsating pressure system includes an air supply (e.g., a pump) and a regulator receiving air from the air supply. The regulator is preferably adapted to deliver air to a plurality of chambers of the an incline device that are separated from each other. Preferably, the regulator is adapted for delivery of either pulsed air or non-pulsed air via outlets of the regulator to each chamber connected to an outlet of the regulator. According to one exemplary embodiment, the regulator is adapted to deliver air to up to four chambers. The pulsating pressure system preferably includes a controller having buttons associated with each outlet of the regulator for switching between a pulsed-air delivery and a non-pulsed air delivery via the outlet. In this manner, any combination of the chambers can be pulsed by the pulsating pressure system.

According to one embodiment, an air supply may include a source of pressurized air and a heating device for raising the temperature of the pressurized air. Preferably, the heating device is connected to the pressurized air source in an in-line manner and can be turned on and off by an operator for delivery of either heated or non-heated air by the air supply. According to one embodiment, an air supply includes a source of pressure air, a heating device and a pulsating pressure system. Alternatively to heating the patient, the patient incline device could also be adapted to cool the patient by providing ventilating openings in an upper surface of an inflatable portion of the incline device on which the patient is received. Preferably, unheated air would be directed to the patient through the ventilating openings to provide cooling ventilation to the patient. Any inflatable component of an incline device according to the invention could be adapted to include ventilating openings, such as the incline ramp, the centerline support and the base member, for example.

According to one aspect of the invention, a system includes a ventilator for delivering a ventilation gas to a patient and a patient incline device. A control system monitors the rate at which ventilation gas is delivered to the patient and adjusts the inflation of one or more inflatable chambers of the incline device in response to changes in the monitored breathing rate of the patient. Preferably, the control system is adapted to provide both a controlled inflation and a controlled deflation of the inflatable chamber. According to one embodiment, the inflation of the incline ramp is varied to adjust the patient In another embodiment, the centerline spinal support is a wedge-shaped air-inflatable chamber located on the incline ramp and angling upward in a direction away from the incline ramp. The peak of the wedge-shaped chamber extends only into the region of the patient's lumbar curve so that inflating the chamber does not lift the patient's buttocks. The wedge-shaped spinal support provides both spinal support and stabilization of the patient on the incline ramp. In a preferred variation of this embodiment, a pop-up air chamber is located on the spinal support chamber in a location approximate to the patient's thoracic curve. This pop-up chamber is inflated by an internal vent from the wedge-shaped spinal support chamber. When the wedge-shaped chamber inflates, the pop-up chamber raises and lifts the thoracic curve of the spine. This lifting provides comfort and a more straightened profile of the spine. As in the other embodiments, the centerline support causes the arms and shoulder blades to fall away to the sides and thereby expanding the chest cavity.

An attachable inflatable accessory is also provided to be used with an incline device where the centerline support does not lift the buttocks, such as the wedge-shaped spinal support described above. The accessory can be attached to the device to lift the buttocks when needed to allow the patient to be positioned with the pelvis or buttocks raised for sanitary care and/or obstetrics or gynecology procedures. The accessory is preferably an inflatable air chamber with side lobes that lie along each side of the incline device (or a transfer pad on which the device is mounted) and a curved seat that inflates below the buttocks. The accessory may be attached to the incline device or transfer pad by hook or snap fasteners for easy attachment and removal.

DESCRIPTION OF THE INVENTION

Figure 1:
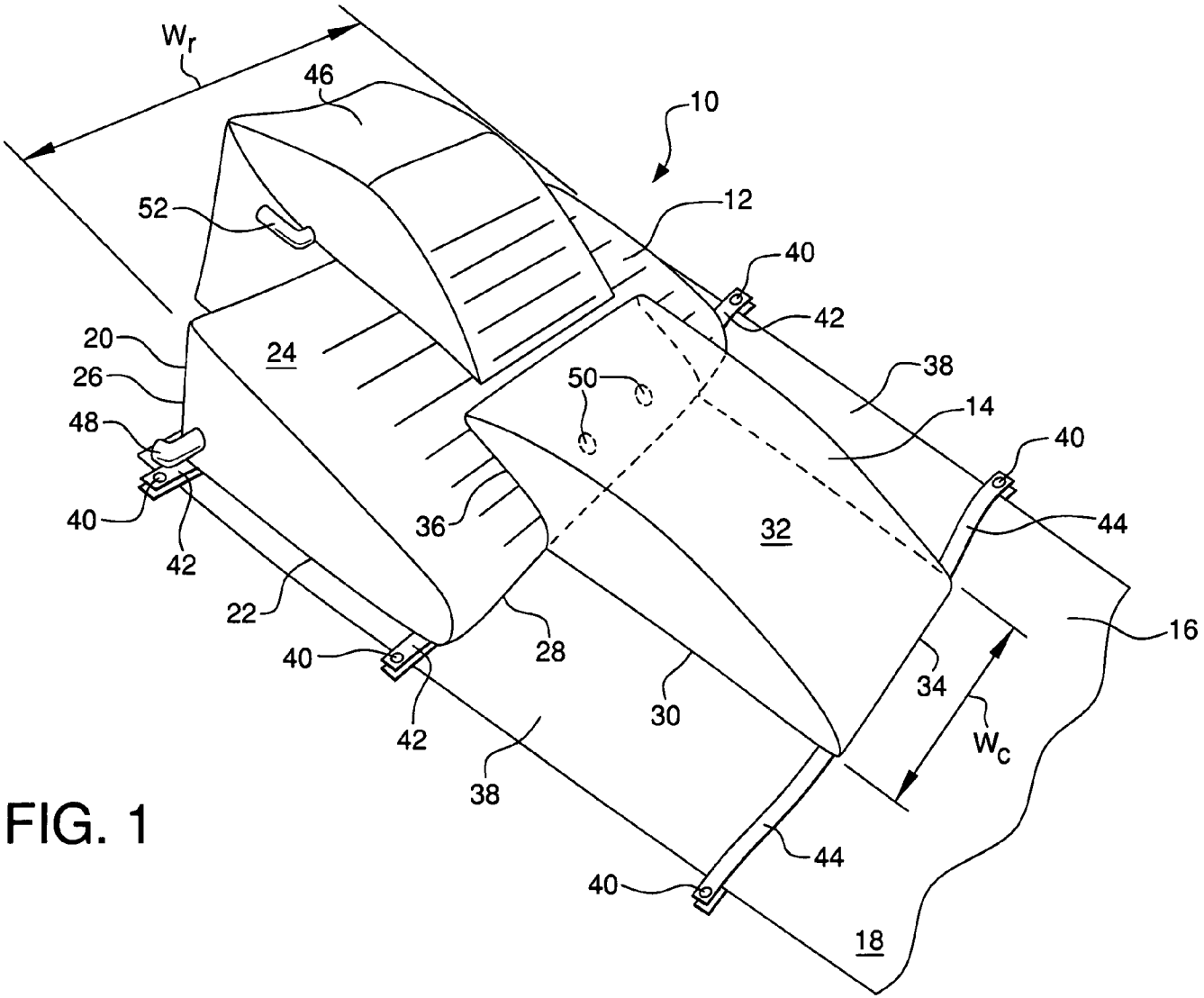
FIG. 1 is a perspective view of an inflatable patient incline device according to a first exemplary embodiment of the invention including an incline ramp, a head support pillow and a centerline spinal support removably attached to a base member.

Referring to the drawings, where like numerals identify like elements, there is shown in FIG. 1*a* patient incline device 10 according to an exemplary embodiment of the invention including an incline ramp 12 and a centerline spinal support 14 located on an upper surface 18 of a base member 16. As described in greater detail below, the centerline spinal support 14 is adapted to contact a central portion of the patient's back adjacent the spine and below the shoulders of the patient and to support the central back portion at a height above the base member 16. The elevated support of the central back portion provides proper support for the spine and laterally redistributes patient mass on opposite sides of the spinal support, especially when the patient is obese. The redistribution of patient mass results in a lateral extension of the chest wall, instead of a relatively collapsed condition associated with incline without the centerline spinal support 14. The lateral extension of the chest wall promotes pulmonary mechanics.

The incline ramp 12 of the device 10 is located on the base member 16 adjacent to a forward or head end 20 of the incline device 10 and is arranged for contact with an upper portion of a patient (e.g., head, neck, upper torso) such that the upper portion of the patient is elevated at an angle with respect to a lower portion of the patient (e.g., legs, feet). The incline ramp 12 includes a substantially planar bottom 22 and an upper surface 24. The upper surface 24 of the incline ramp 12 slopes downwardly from a forward end 26 of the incline ramp 12 (i.e., the end of the incline ramp 12 located adjacent the head end 20 of the device 10) towards a rearward end 28 of the incline ramp 12. The slope of the upper surface 24 of incline ramp 12 is substantially constant along a majority of the ramp's length. As a result, the incline ramp 12 has a cross-section that is generally triangular in shape to provide the above-described angled elevation of the upper portion of the patient.

The centerline spinal support 14 of the incline device 10 includes a substantially planar bottom 30 and an upper surface 32. The depicted spinal support 14 decreases in vertical thickness towards a rearward end 34 of the centerline spinal support 14 (i.e., as one moves away from the head end 20 of the device 10 and towards a foot end that is not shown). The upper surface 32 of the centerline spinal support 14 is not sloped at a constant angle and, instead, defines a curving profile along a majority of it's length. Thus, unlike the incline ramp 12, which is generally triangular in cross-section, the depicted spinal support 14 defines a rounded profile. The centerline spinal support 14 is located on the base member 16 rearwardly of the incline ramp 12 and preferably is located immediately adjacent the incline ramp 12 in contact with a portion of the incline ramp 12. As shown, the spinal support 14 includes a forward end 36 that is preferably angled obliquely with respect to the bottom 30 such that substantially the entire forward end 36 of the spinal support 14 contacts the incline ramp 12. Positioned immediately rearward of the incline ramp 12 in this manner, the spinal support 14 is arranged to contact the back of a patient who is received on the incline device 10 and elevated by the incline ramp 12 of the device 10.

The centerline spinal support 14 has a width, $W_c$, which is reduced with respect to a width, $W_r$, of the incline ramp 12. As shown, the spinal support 14 is located in a substantially centered fashion with respect to the adjacent incline ramp 12. Centrally located in this manner with respect to the incline ramp 12, the centerline spinal support is adapted for contact with a middle portion of the patient's back near the spine of the patient. A space 38 is defined along each of opposite lateral sides of the spinal support 14 because of the above-described reduced width, $W_c$, of the spinal support 14. Each space 38 is adapted for receiving a portion of the patient's arms, and perhaps other laterally-portions of the patient in the case of an obese patient.

As described above, the centerline spinal support 14 is located immediately rearward of the incline ramp 12. As a result, the centerline spinal support 14 is arranged to contact the patient's back adjacent the spine such that the spine is supported by the spinal support 14. The support of the spine by the spinal support 14 limits curvature of the spine that might otherwise result from incline of the patient without the spinal support 14. The upper surface 32 of the depicted spinal support 14 is convexly curved along a majority of its length to define a generally rounded profile. This is not a requirement of the invention, however. The upper surface 32 of the spinal support 14 is not limited to any particular shape and could, for example, include a substantially constant slope along a majority of its length to define a generally triangular cross section.

As also described above, laterally-located portions of the patient including a portion of the patient's arms are located in the spaces 38 defined along the opposite lateral sides of the centerline spinal support 14 for support on the upper surface 18 of the base member 16. Therefore, the central portion of the patient's back adjacent the spine is supported at a height (i.e., lifted) above the opposite lateral side portions of the patient in the spaces 38. The lifting of the spinal area in this manner with respect to the side portions of the patient redistributes patient mass outwardly, thereby resulting in an associated lateral extension of the chest wall. In the case of an obese patient, gravity forces acting on large fat accumulations that would otherwise be compressing the chest wall area absent the centerline spinal support 14 will tend to draw the fat accumulations into the spaces on the base member 16 beside the centerline spinal support 14. The resulting configuration of the patient supported on the incline device 10 is somewhat analogous to that resulting when a standing person arches the back and draws the arms backwardly to "thrust" the chest forwardly.

According to one presently preferred embodiment, the base member 16 comprises a flexible sheet made from any suitable therapeutic material. A flexible sheet, however, is not required. Other base members could be used including base members that are substantially rigid in construction. As shown, the incline ramp 12 and centerline spinal support 14 are attached to the base member 16 by suitable fasteners 40 carried on peripheral tabs 42 and straps 44 respectively connected to the incline ramp 12 and the spinal support 14. Preferably, the fasteners 40 comprise snap members as depicted. Any suitable means of attachment, however, could be used instead of the depicted snap members.

As should be understood, the attachment between the base member 16 and the incline ramp 12 and spinal support 14 provided by the fasteners provides for alternative attachment of the incline ramp 12 and spinal support 14 to any suitable underlying support member instead of the depicted base member 16. Also, it is not required that the incline ramp 12 and spinal support 14 be removable as depicted. As an alternative, the incline ramp 12 and spinal support 14 could instead be incorporated in an integral, non-removable manner with an underlying support member (e.g., a sheet, an inflatable or static pad, an inflatable transfer device, etc.). In addition, it is conceivable that the spinal support 14 and incline ramp 12 could be adapted for separation from each other such that the incline ramp 12 could be used without the spinal support 14.

The depicted patient incline device 10 includes a head support pillow 46 for supporting the patient's head. As shown, a portion of the head support pillow 46 is located on the upper surface 24 of the incline ramp 12 adjacent the head end 20 of the incline device 10. The head support pillow 46 is preferably centrally located between opposite lateral sides of the incline ramp 12 such that the head support pillow 46 is substantially aligned with the spinal support 14.

Each of the incline ramp 12, centerline spinal support 14, and head support pillow 46 of patient incline device 10 is inflatable. The patient incline device 10 includes an inlet 48 connected to the incline ramp 12 for introducing a gas such as air (e.g., by attaching an air pump to the inlet 48) into an internal chamber defined by the incline ramp. As shown, the device 10 includes openings 50 communicating between the incline ramp 12 and the centerline spinal support 14 such that air from the incline ramp 12 will be transferred into the centerline spinal support 14 to inflate the spinal support 14. In this manner, the incline ramp 12 and centerline spinal support 14 are both inflated from air introduced in the incline ramp 12 via the air inlet 48.

The patient incline device 10 includes a second inlet 52 connected to the head support pillow 46 for inflating the head support pillow 46 (e.g., by attaching an air pump to the inlet 52). Preferably, the interior of the head support pillow 46 is separated from the interior of the incline ramp 12 to provide for independent inflation of the support pillow 46 and incline ramp 12. In this manner, the incline ramp 12 can be separately inflated for use without the head support pillow 46, for example.

Figure 2:
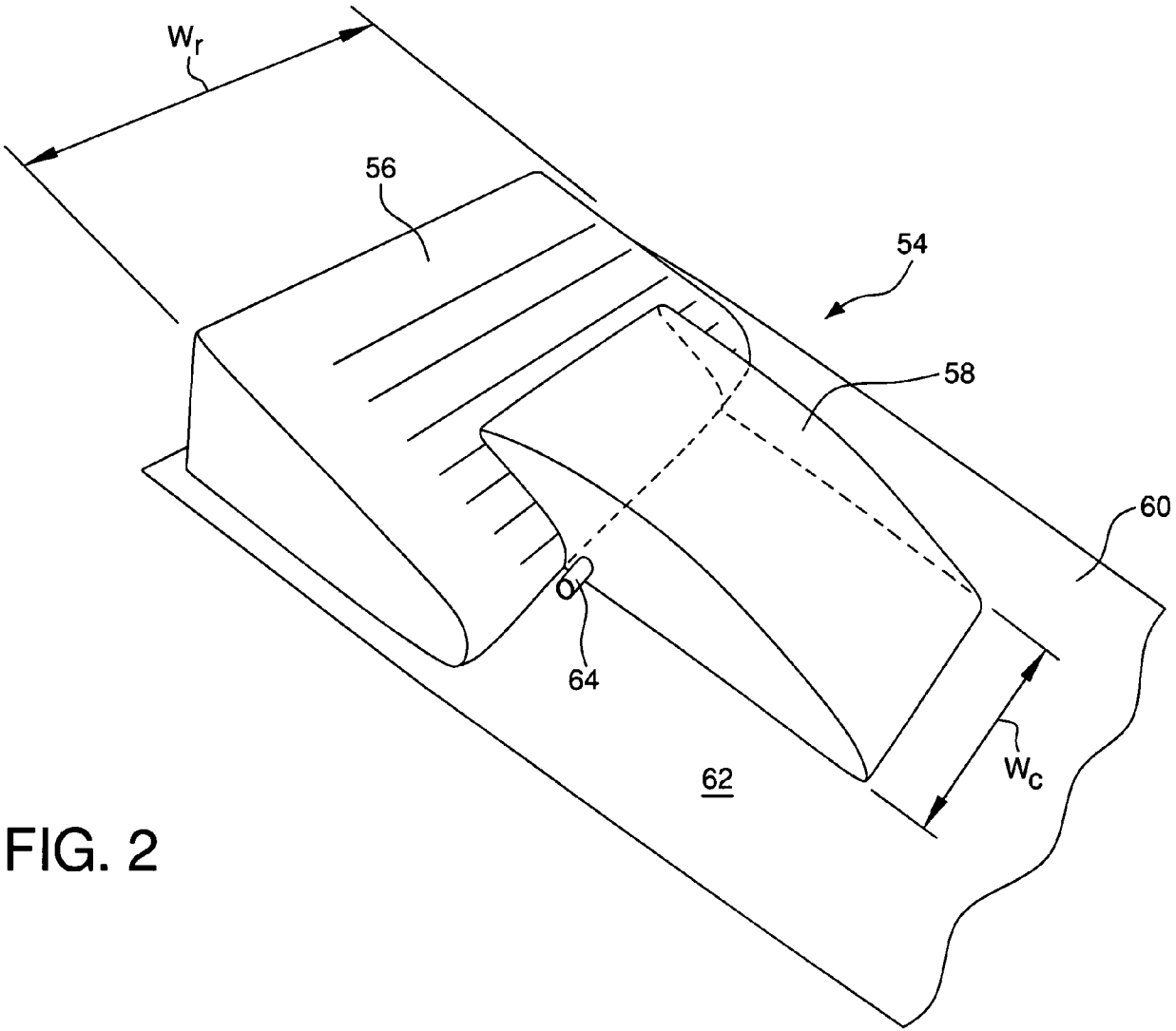
FIG. 2 is a perspective view of a patient incline device according to a second exemplary embodiment of the invention including a static incline ramp and an inflatable centerline spinal support secured to a base member.

Referring to FIG. 2, there is shown a patient incline device 54 according to a second exemplary embodiment of the invention. Similar to the incline device 10 of FIG. 1, the incline device 54 includes an incline ramp 56 for elevating an upper portion of a patient and a centerline spinal support 58. Like the spinal support 14 of incline device 10, the spinal support 58 of incline device 54 is located rearward of the incline ramp 56 to properly support the spinal area of the back and to lift the spinal area with respect to side portions of the patient to laterally extend the chest wall. The incline ramp 56 and centerline spinal support 58 are located on an upper surface 62 of a base member 60.

The centerline spinal support 58, like the spinal support 14 of incline device 10, is inflatable. An inlet 64 is connected to the spinal support 58 for introducing a gas such as air into the interior of the spinal support 58. The incline ramp 56 of patient incline device 54, however, is preferably not inflatable. Suitable cushioning materials for filling the interior of incline ramp 56 include a foam, batting, or gel material. Constructed in this manner to include an inflatable spinal support 58, the incline device 54 desirably provides for inclined support of a patient on the static (i.e., non-inflatable) incline ramp 56 of device 54 with or without the additional support being provided by the inflatable spinal support 58. It is conceivable, however, that the centerline spinal support 58 could also be non-inflatable like the incline ramp 56 by including a cushioning filler material such as foam, batting or gel in the interior of the spinal support 58.

The incline ramp 56 and centerline spinal support 58 of incline device 54 preferably are secured to the upper surface 62 of base member 60 and, therefore, are not adapted for removal from the base member 60 in the above-described manner for incline device 10.

As shown, the relative dimensions between the incline ramp 56 and centerline spinal support 58 of incline device 54 are similar to those of patient incline device 10 such that spaces are defined above the upper surface 62 of base member 60 along opposite lateral sides of the spinal support 58. In the manner described above for device 10, these spaces are adapted for receiving side portions of a patient, particularly those of an obese patient, when the spine of the patient is supported on the spinal support 58.

Figure 3A:
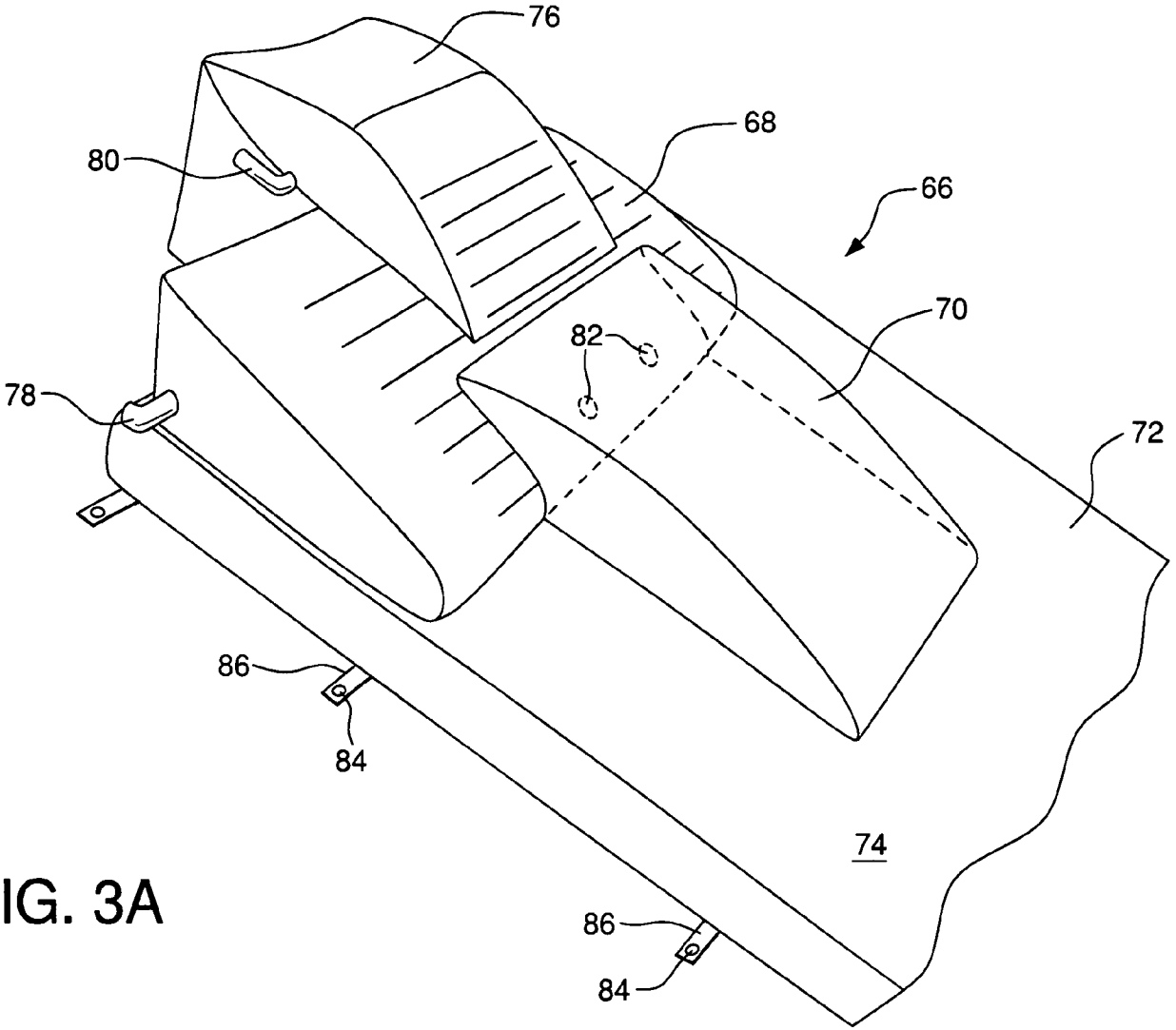
FIG. 3A is a perspective view of a patient incline device according to a third exemplary embodiment including an incline ramp, a head support pillow and a centerline spinal support secured to a pad.

Referring to FIG. 3A, there is shown a patient incline device 66 according to a third exemplary embodiment of the invention. The incline device 66 includes an incline ramp 68 and a centerline spinal support 70 located on an upper surface 74 of a base pad 72. The incline device 66 also includes a head support pillow 76 located on the incline ramp 68 adjacent a head end of the incline device 66. Preferably, each of the incline ramp 68, the centerline spinal support 70 and the head support pillow 76 is inflatable. Like the incline device 10 of FIG. 1, the patient incline device 66 includes inlets 78, 80 for inflating the incline ramp 68 and head support pillow 76, respectively, and holes 82 between the incline ramp 68 and the spinal support 70 for inflating the spinal support 70. The base pad 72 could define an inflatable chamber. Alternatively, the base pad 72 could include any suitable supporting material in an interior of the base pad (e.g., foam, gel, cotton, etc.).

In a similar manner as that described above for devices 10, 54, the incline ramp 68 and centerline spinal support 70 of device 66 are dimensioned with respect to each other so as to define spaces on the upper surface 74 of base pad 72 along each of opposite lateral sides of the spinal support 70. As described above, these spaces are adapted to receive opposite side portions of a patient, particularly an obese patient, whose spine is supported by the spinal support 70.

The patient incline device 66 includes fasteners 84 located on tabs 86 connected to the base pad 72 about the periphery of the base pad 72 and adjacent a bottom surface of the pad. Arranged in this manner, the fasteners 84 provide for removable attachment of the device 66 to an underlying support member, or to attach an accessory to the device 66.

The incline device 66 also includes a head support pillow 76 located on the incline ramp 68 adjacent a head end of the incline device 66. Preferably, each of the incline ramp 68, the centerline spinal support 70 and the head support pillow 76 is inflatable. Like the incline device 10 of FIG. 1, the patient incline device 66 includes inlets 78, 80 for inflating the incline ramp 68 and head support pillow 76, respectively, and holes 82 between the incline ramp 68 and the spinal support 70 for inflating the spinal support 70. The base pad 72 could define an inflatable chamber. Alternatively, the base pad 72 could include any suitable supporting material in an interior of the base pad (e.g., foam, gel, cotton, etc.).

Figure 3B:
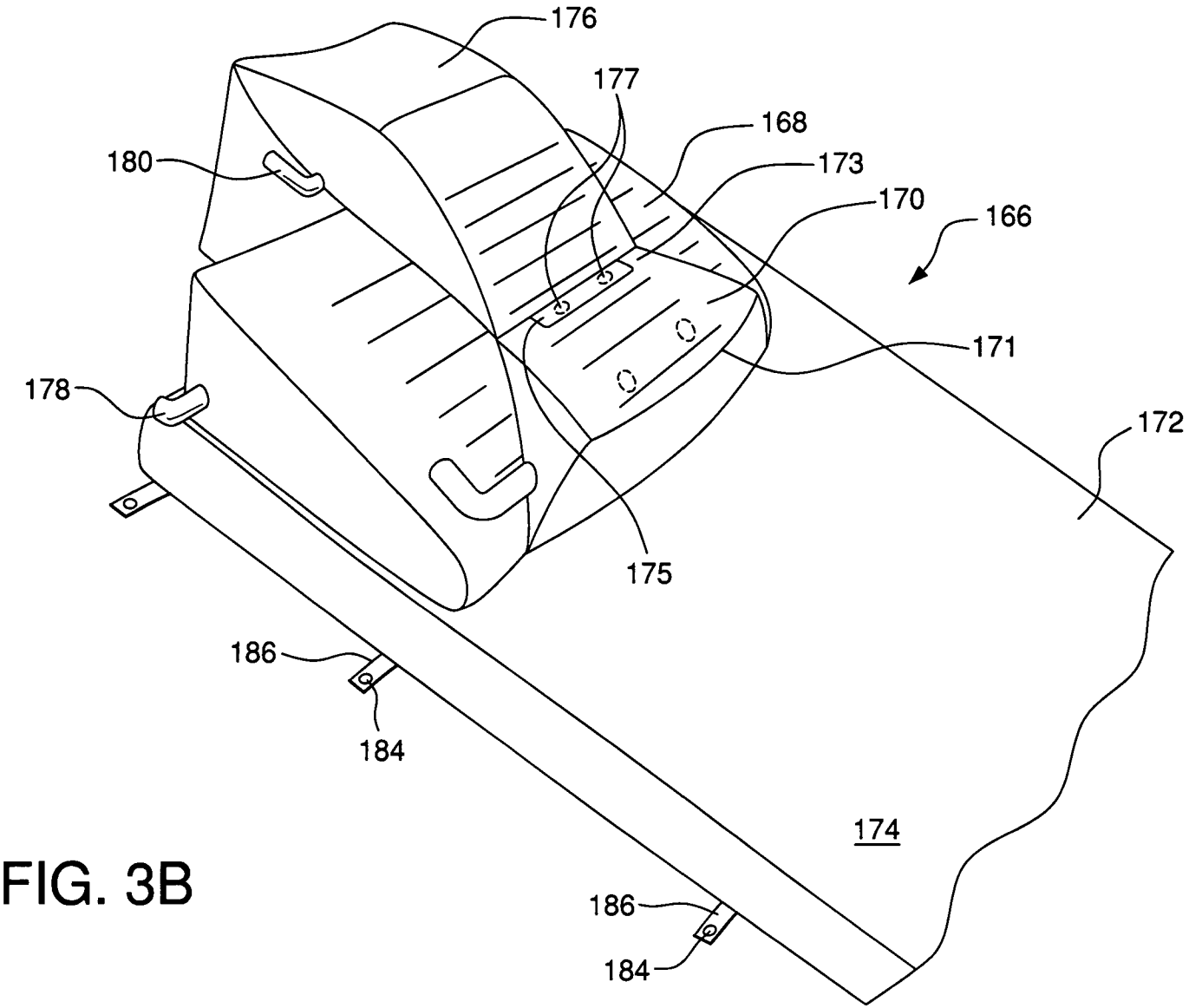
FIG. 3B is a perspective view of a patient incline device similar to that shown in FIGS. 1 and 3, except that the centerline spinal support is a wedge-shaped air-inflatable chamber located on the incline ramp and angling upward in a direction away from the incline ramp such that the peak of the wedge-shaped chamber extends only to the region of the patient's lumbar curve.

A new embodiment is shown in FIG. 3B. The incline device 166 includes an incline ramp 168 and a centerline spinal support 170 located on the upper surface 174 of a base pad 172. Unlike the centerline spinal support having an elongated profile and potentially extending under the area of the patient's buttocks, however, the spinal support 170 is a wedge-shaped air-inflatable chamber located on the incline ramp and angling upward in a direction away from the incline ramp. The peak 171 of the wedge-shaped chamber extends only into the region of the patient's lumbar curve. The opposite narrow side of the wedge 173 extends from about the base of the head rest pillow 176. The wedge-shaped spinal support provides increased stabilization of the patient on the incline ramp. Since the buttocks of the patient are not lifted when the spinal support wedge inflates, much of the weight of the patient is transferred through the buttocks directly onto the base pad 172, which provides an anchor point of a three point stabilization (the head-end sides of the ramp under the shoulders provide the other two points).

In a preferred variation of the preceding embodiments, a pop-up air chamber 175 is located on the spinal support chamber 170 near the narrow side 173 of the wedge in a location approximate to being below the thoracic curve portion of a patient's spine. This pop-up chamber 175 is inflated by internal vents 177 from the wedge-shaped spinal support chamber. When the spinal support chamber 170 inflates, the pop-up chamber 175 will rise as pressure accumulates under the patient's back, and lift the thoracic curve region of the spine to produce a more straightened profile of the spine, reducing muscle fatigue and allowing the arms and shoulder blades to fall away to the sides to expand the chest cavity. The wedge-shaped spinal support with pop-up chamber is a preferred embodiment for the incline devices.

Figure 3C:
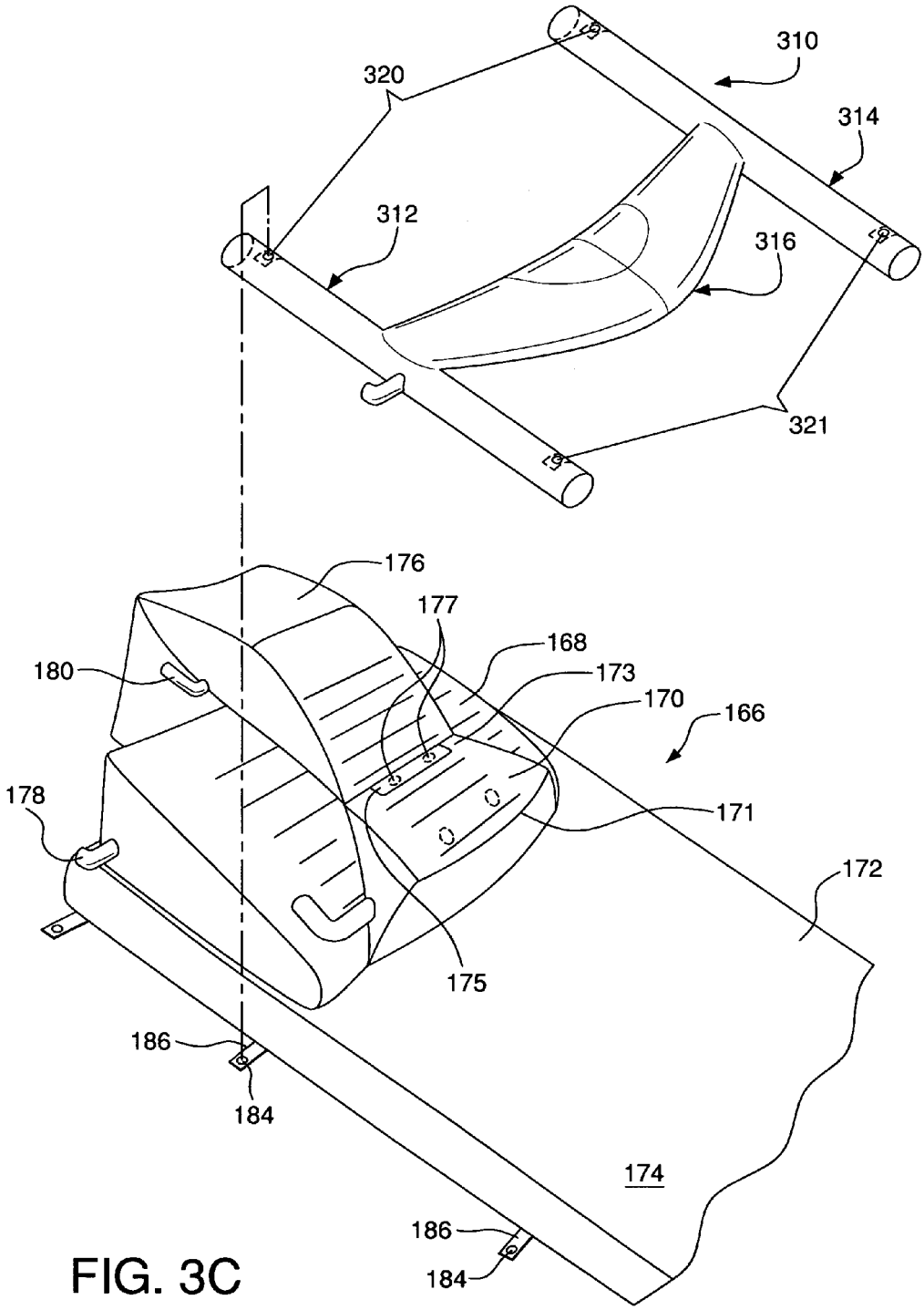
FIG. 3C is a perspective view of the patient incline device of FIG. 3B in combination with a removable accessory to raise the patient's buttocks and pelvis for sanitary care or medical procedures.

The wedge-shaped spinal support does not extend past the lower spine and hence does not elevate the pelvis and buttocks, as described above. There are situations, however, when the medical staff may wish to elevate these part of the anatomy for hygiene and sanitary care (washing, bed pan, etc.) or medical procedures such as obstetrics or gynecology procedures. An accessory lift device 310 as shown in FIG. 3C is provided for this purpose. The accessory lift device 310 is an inflatable air chamber with side lobes 312, 314 that lie along each side of the base pad 172 of the incline device (or a transfer pad on which the device is mounted) and a curved seat portion 316 that crosses over the base pad 172 and inflates in the area of the patient's buttocks. The accessory lift device may be attached to the incline device base pad or transfer pad by hook or snap fasteners 320, 321 for easy attachment and removal from the incline device. In an alternative embodiment, the accessory could be built into the incline device and have a separate valve or air nozzle so that it can be inflated only as needed to raise the buttocks.

Figure 4:
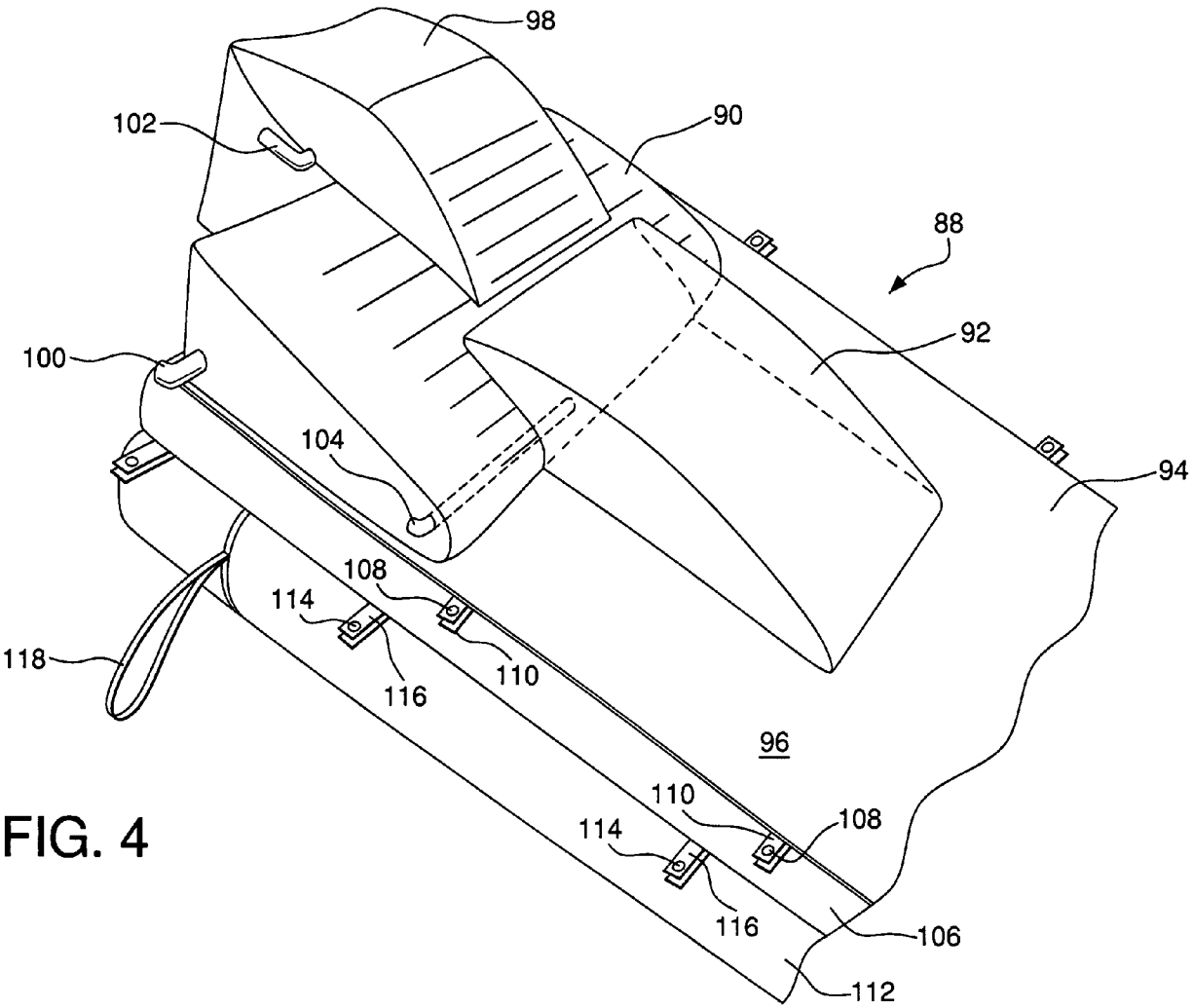
FIG. 4 is a perspective view of a patient incline device according to a fourth exemplary embodiment including an incline ramp, a head support pillow, a centerline spinal support, a base member, a pad, and an inflatable transfer device.

Referring to FIG. 4, there is shown an inflatable patient incline device 88 according to a fourth exemplary embodiment of the invention. The incline device 88 includes an incline ramp 90 and a centerline spinal support 92 located on an upper surface 96 of a base member 94. The incline device 88 also includes a head support pillow 98 located on the incline ramp 90 adjacent a head end of the incline device 88. Preferably, each of the incline ramp 90, the centerline spinal support 92 and the head support pillow 98 is inflatable. Like the incline device 66, the patient incline device 88 includes inlets 100, 102 for inflating the incline ramp 90 and head support pillow 98, respectively. Unlike incline device 66, however, the device 88 does not include inflation holes between the incline ramp 90 and spinal support 92 and, instead, includes a separate inlet 104 for inflating the spinal support 92. As shown, the 104 inlet is elongated to extend to the spinal support 92 through an interior portion of the incline ramp 90. The inlet 104 extends from a side surface of the incline ramp 90 for receiving a gas (e.g., air) from a source (e.g., an air pump). This arrangement desirably locates the exterior portion of the inlet 104 away from the lateral sides of the spinal support 92, thereby limiting contact between the patient the inlet 104 in the spaces defined along the opposite lateral sides of the spinal support 92.

The patient incline device 88 includes a pad 106. Similar to base pad 72 of device 66, the pad 106 could comprise an inflatable chamber or, alternatively, could include any suitable supporting material in an interior of the pad 106. The base member 94 is located on an upper surface of the pad 106. According to one presently preferred embodiment, the base member 94 comprises a flexible sheet. However, this is not required and the base member 94 could be substantially rigid in construction. The device 88 includes fasteners 108 mounted on tabs 110 about the periphery of the base member 94. The fasteners 108 are attached to cooperative fasteners mounted on tabs located about the periphery of the pad 106. This arrangement provides for a releasable attachment between the base member 94 of incline device 88 and the pad 106.

The patient incline device 88 also includes a patient transfer device 112. The patient transfer device 112, in the well known manner, includes an inflatable plenum and holes in a bottom surface to create a load-bearing cushion of escaping air beneath the transfer device 112 to facilitate sliding. The pad 106 of the patient incline device 88 is located on an upper surface of the patient transfer device 112. The incline device 88 includes fasteners 114 mounted on tabs 116 located about the periphery of the pad 106 adapted for releasable attachment to cooperative fasteners mounted on tabs located about the periphery of the transfer device 112. Similar to the fasteners 108, the fasteners 114 provide for a releasable attachment between the pad 106 and the transfer device 112. To facilitate the sliding movement of the patient incline device 88 along an underlying surface, the incline device includes pull straps 118 on the transfer device 112. As shown, the pull straps 118 are located along lateral sides of the transfer device 112 to facilitate the application of a pulling force to the sides of the transfer device 112.

Figure 5:
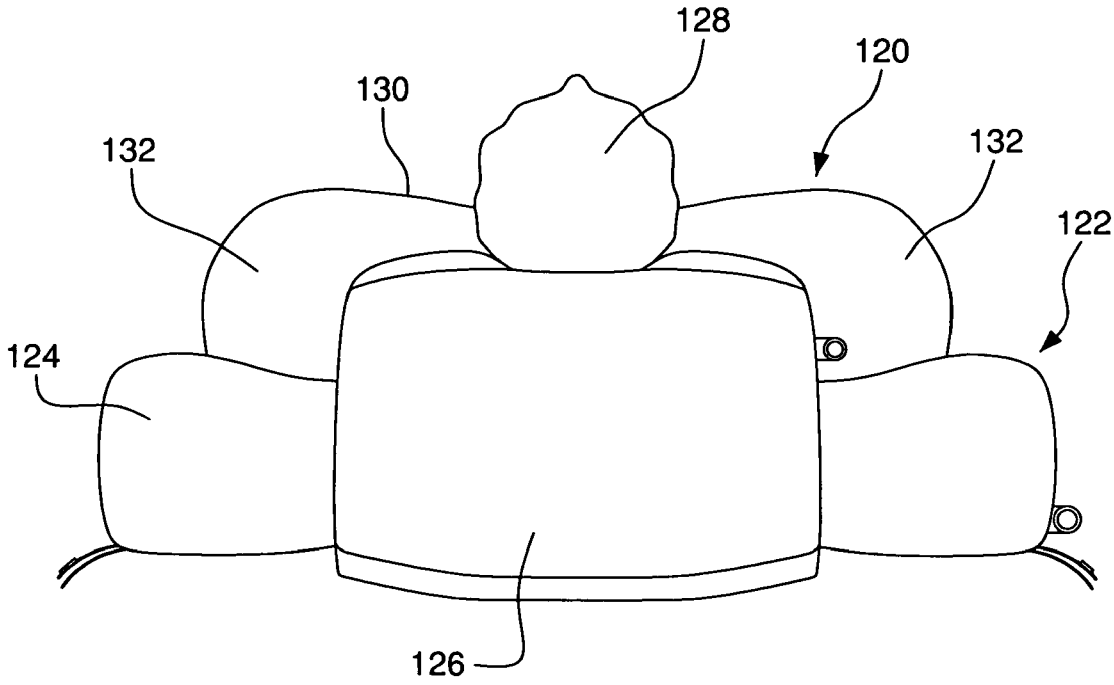
FIGS. 5 and 6 are end views of a patient supported on a patient incline device illustrating the effect on a supported patient provided by the centerline spinal support of the present invention.

Referring to FIGS. 5 through 8, the lateral chest wall extension and spinal support provided by the above-described centerline spinal support of the present invention is illustrated. Referring first to FIG. 5, an obese patient 120 is shown laying on an incline device 122 having an incline ramp 124 elevating the upper portion of the patient and a head support pillow 126 located at a head end of the incline device 122 for supporting the head 128 of the patient. The incline device 122, however, either does not include a centerline spinal support according to the present invention or, alternatively, includes a spinal support that is in a deflated condition. As shown, the elevation of the upper portion of the patient 120 provided by the incline ramp 124 without a spinal supporting lifting the spine causes the chest wall 130 of the patient 120 to collapse with respect to opposite lateral side portions 132 of the patient 120.

Figure 6:
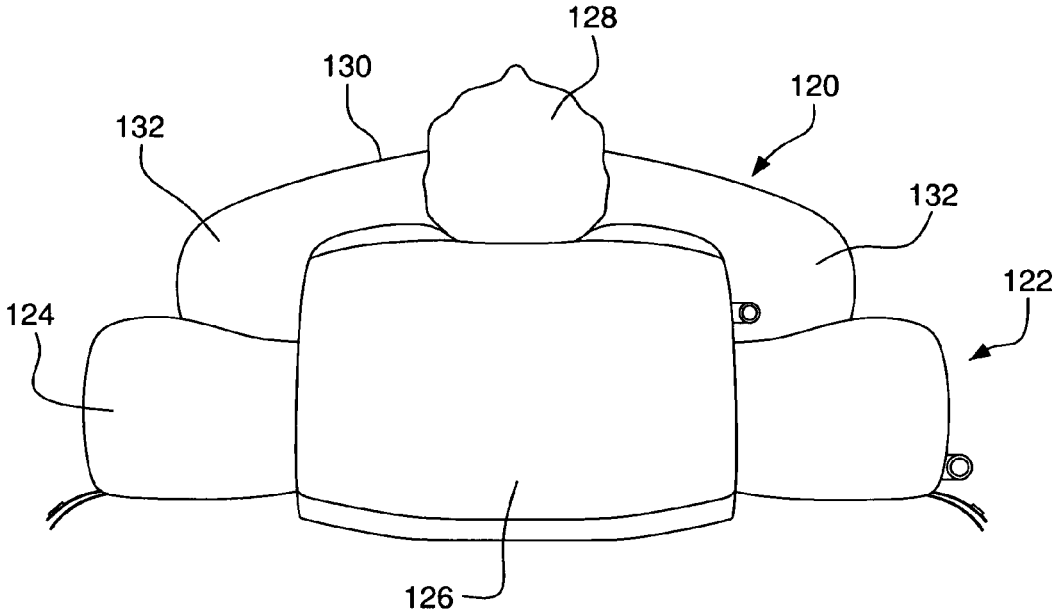

Referring now to FIG. 6, the incline device 122 has now been provided with a centerline spinal support or, alternatively, a previously deflated spinal support has now been inflated. As described above, the centerline spinal support of the present invention contacts and supports the spinal area of the back to limit curvature of the spine and lifts the spine with respect to opposite side portions 132 of the patient 120, which are supported in the spaces defined on opposite sides of the spinal support. The resulting redistribution of patient mass into the spaces beside the spinal support of incline device 122 in the above-described manner causes the chest wall 130 of the patient 120 to be extended laterally outwardly in FIG. 6 compared to the condition of the chest wall 130 shown in FIG. 5.

Figure 7:
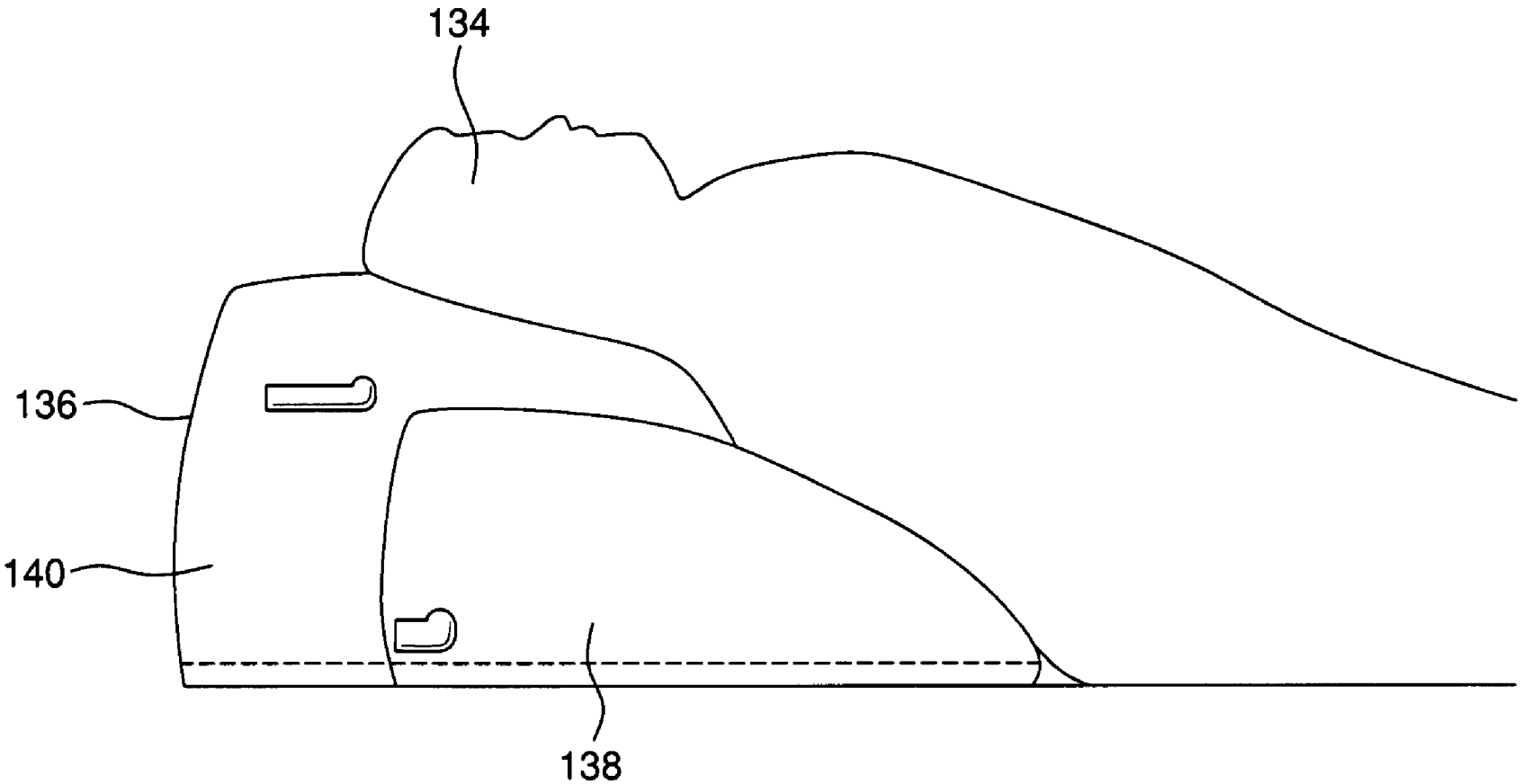
FIGS. 7 and 8 are side views of a patient supported on a patient incline device illustrating the effect on a supported patient provided by the centerline spinal support of the present invention.
Figure 8:
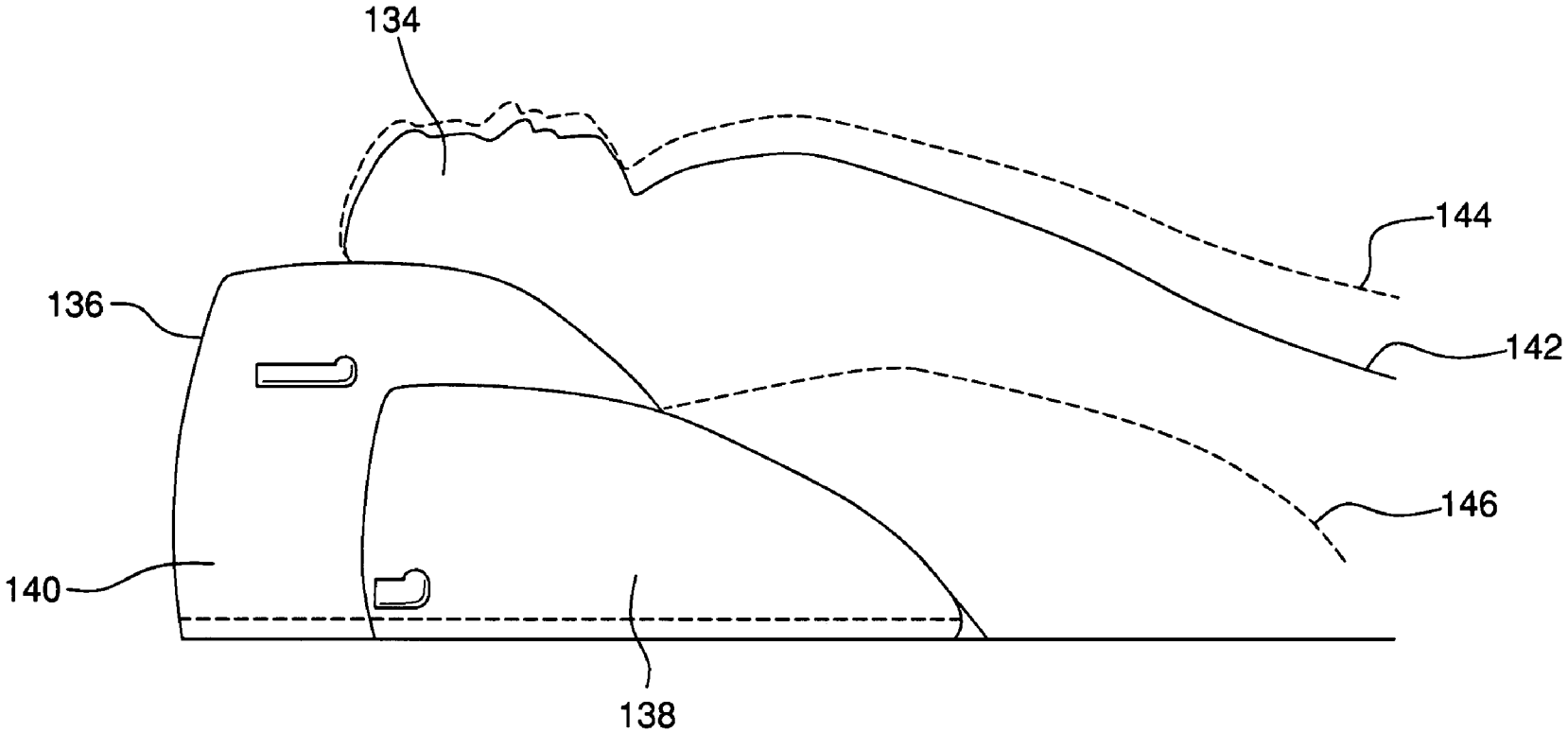

Referring to FIGS. 7 and 8, the effect of the centerline spinal support of the present invention is illustrated from a side view of a patient 134. Referring first to FIG. 7, the patient 134 is shown supported on an incline device 136 having an incline ramp 138 and a head support pillow 140. The incline device 136 depicted in FIG. 7 either does not include a centerline spinal support or, alternatively, includes a spinal support that is in a deflated condition.

Referring to FIG. 8, the change in the position of patient 134 by providing a centerline spinal support in the above-described manner is illustrated. The outline of patient 134 without the spinal support providing support for the patient is shown in FIG. 8 by solid line 142. The outline of the patient with the spinal support of the present invention providing support is shown in FIG. 8 by the dashed line 144. As discussed above, the centerline spinal support of the present invention is adapted to contact a central portion of the patient's back located below the shoulders of the patient and support the central back portion at a height above the base of the incline device. The elevated support of the central portion of the patient's back provided by the spinal support of the present invention is illustrated in FIG. 8 by dashed line 146. As shown, the change in the supported position of the central portion of the patient's back with the centerline support (i.e., the height supported height represented by dashed line 146) is relatively large compared to the change in the outline of the patient (i.e., the vertical distance between lines 142 and 144). This results because of the above-described redistribution of patient mass. While the spinal region is elevated by the centerline spinal support to the desired condition represented by dashed line 146, the patient mass that had previously been located in the chest wall region is now redistributed laterally into the lateral side spaces extending beside the spinal support. As a result, the overall outline of the patient is raised only slightly compared to the vertical change in the spinal region of the patient.

The outward lateral extension of the chest wall provided by the centerline spinal support of the present invention improves pulmonary mechanics. Abnormal diaphragm position and upper airway resistance are attenuated. Functional residual capacity, vital capacity, total lung capacity, inspiratory capacity, minute ventilatory volume, and expiratory reserve volume are all improved. Furthermore, the safe apnea period following a pre-oxygenation procedure during an anesthetic induction is desirably prolonged because of improved chest wall compliance.

A particularly beneficial application of the incline device having centerline spinal support according to the present invention is for patients having ARDS (acute respiratory distress syndrome). ARDS patients are subject to inflammation caused by fluid buildup in the lungs and external compression of the lower lung lobes by an enlarged heart or other abdominal weight exerted on the lung.

Figure 9:
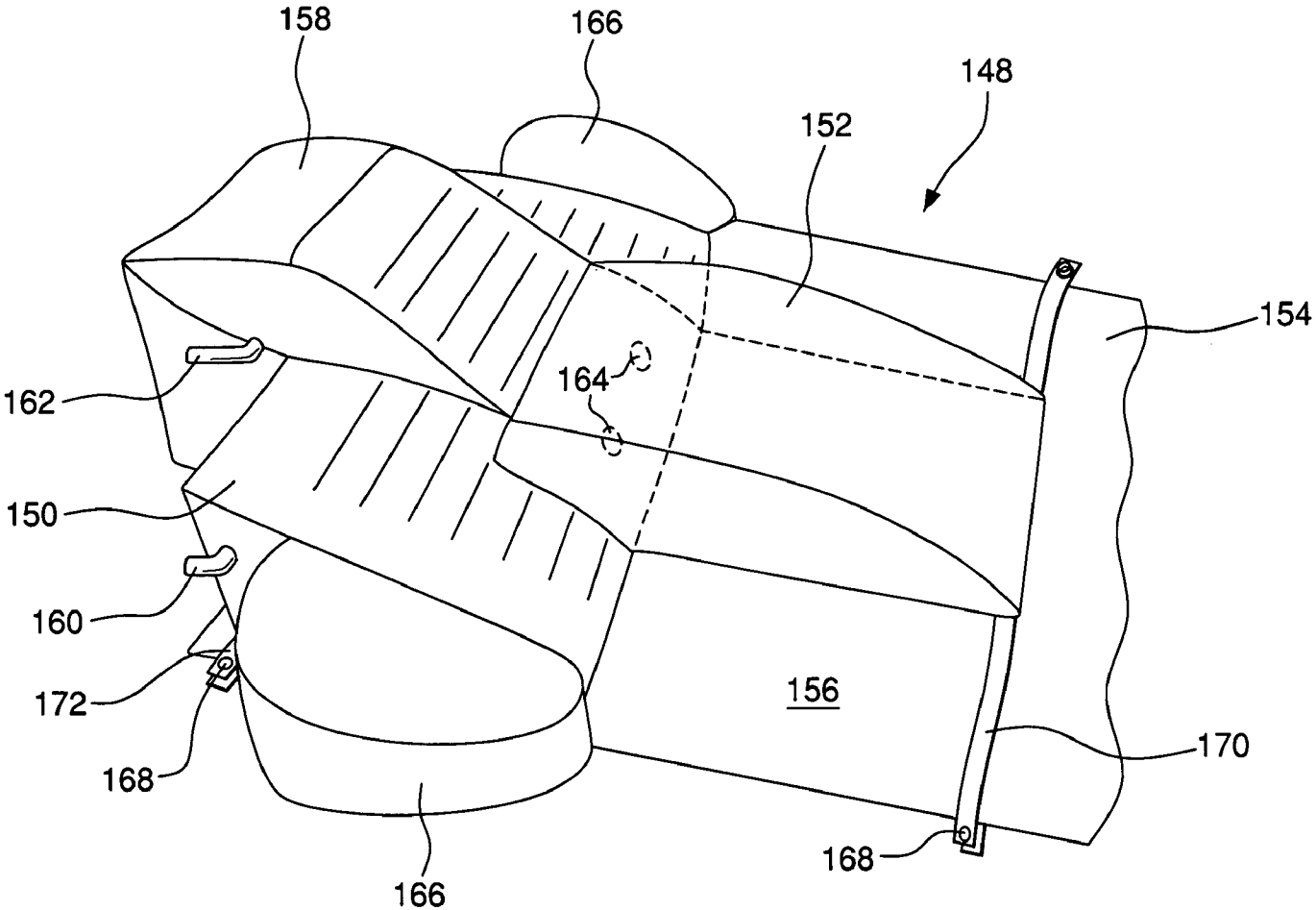
FIG. 9 is a perspective view of patient incline device according to a fifth exemplary embodiment of the invention including an incline ramp, a head support pillow, a centerline spinal support, and clavicle area supports located on opposite sides of the incline ramp.

Referring to FIG. 9, there is shown a patient incline device 148 according to a fifth exemplary embodiment of the invention. The patient incline device 148 includes an incline ramp 150 and a centerline spinal support 152 located on an upper surface 156 of a base member 154. The incline device 148 also includes a head support pillow 158 located on the incline ramp 150 adjacent a head end of the incline device 148. Preferably, each of the incline ramp 150, the spinal support 152 and the head support pillow 158 is inflatable. Like the incline device 10 of FIG. 1, the patient incline device 148 includes inlets 160, 162 for inflating the incline ramp 150 and head support pillow 158, respectively, and holes 164 between the incline ramp 150 and the spinal support 152 for inflating the spinal support 152.

The patient incline device 148 of FIG. 9 includes clavicle area supports 166 on each of opposite sides of the incline ramp 150 for contacting and supporting the shoulder areas of a patient being elevated by the incline ramp 150 of the device 148. Preferably, the clavicle area supports 166 are inflatable and have interiors that are separated from the interior of the incline ramp 150 of device 148 to provide for use of the device 148 without the clavicle area supports 166. The device includes fasteners 168 on straps 172 and tabs 174 providing a releasable attachment of the incline ramp 150, the spinal support 152, the head support pillow 158 and the clavicle area supports 166 to the base member 154.

As described above, the centerline spinal support 152 of the present invention lifts the spine into a proper position and redistributes patient mass such that the chest wall of the patient is extended outwardly. The redistribution of patient mass provided by the support of the patient on the spinal support 152 also has the additional benefit of placing the clavicle areas and the subclavian vessels of the patient in a more prominent position than would result from incline of the patient without the spinal support 152. This facilitates central venous access in the area of the patient's clavicle areas, thereby obviating the need for traditional forms of patient positioning using hospital linen and towels. The support of the shoulder areas of the patient provided by the clavicle area supports 166 desirably relieves stress that might otherwise be placed on this region of the patient, particularly obese patients, thereby promoting vascular integrity and patient comfort.

Figure 10:
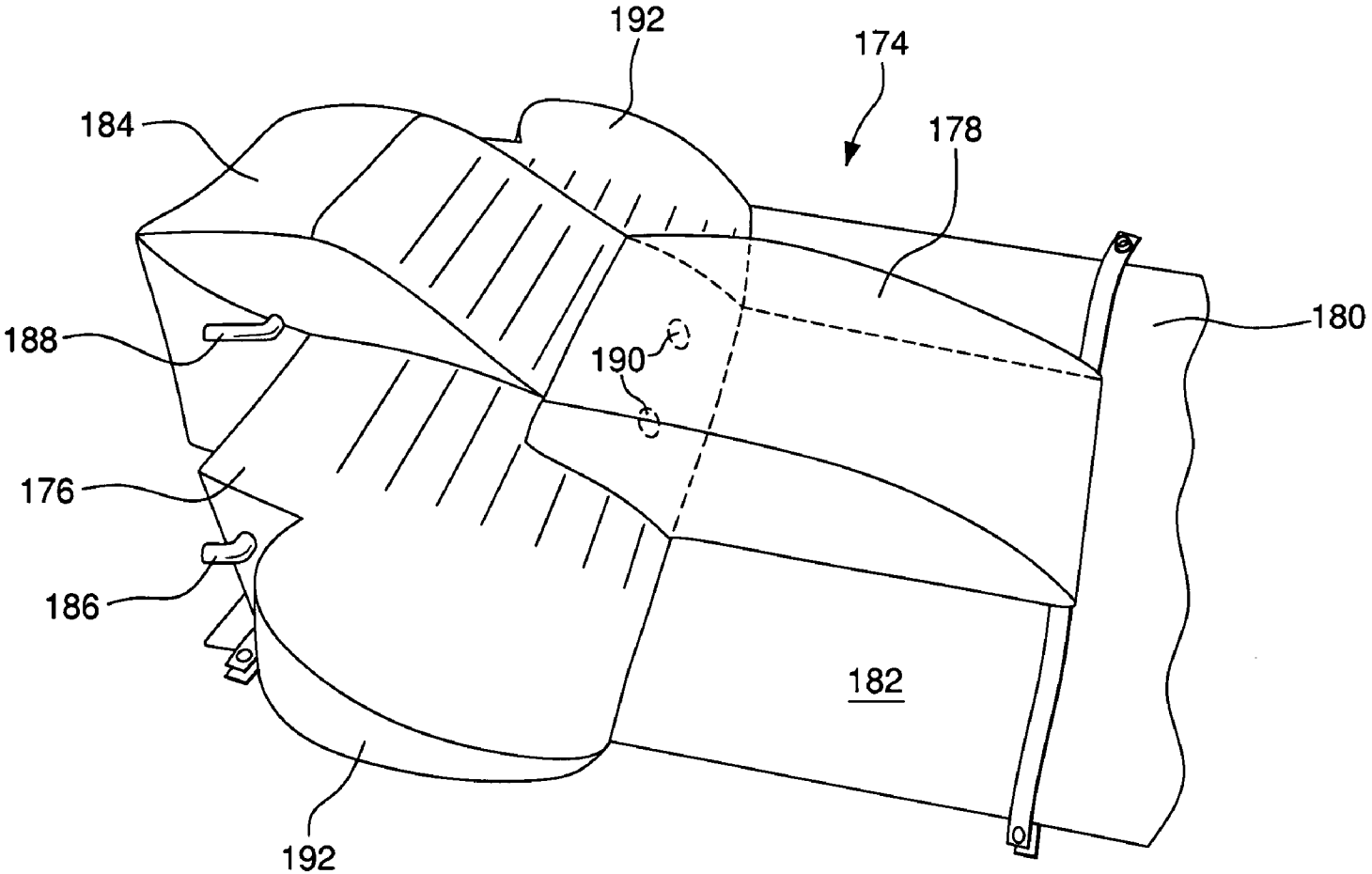
FIG. 10 is a perspective view of a patient incline device according to a sixth exemplary embodiment including an incline ramp having clavicle area support regions located on opposite sides of the incline ramp as integral extensions of the incline ramp.

Referring to FIG. 10, there is shown a patient incline device 174 according to a sixth exemplary embodiment of the invention. The patient incline device 174 includes an incline ramp 176 and a centerline spinal support 178 located on an upper surface 182 of a base member 180. The incline device 174 also includes a head support pillow 184 located on the incline ramp 176 adjacent a head end of the incline device 174. Preferably, each of the incline ramp 176, the spinal support 178 and the head support pillow 184 is inflatable. Like the incline device 10 of FIG. 1, the patient incline device 174 includes inlets 186, 188 for inflating the incline ramp 176 and head support pillow 184, respectively, and holes 190 between the incline ramp 176 and the spinal support 178 for inflating the spinal support 178.

The incline ramp 176 of the patient incline device 174 includes clavicle area support regions 192 extending outwardly on opposite sides of the incline ramp 176. The clavicle area support regions 192 of the incline ramp 176 of device 174 are preferably dimensioned in generally the same manner as the clavicle area supports 166 of incline device 148 and function in a similar manner to support the shoulder areas of a patient. The clavicle area support regions 192, however, do not include interiors that are separated from the interior of the incline ramp 176 and, instead, define integral extensions of the interior of the incline ramp 176.

Figure 11:
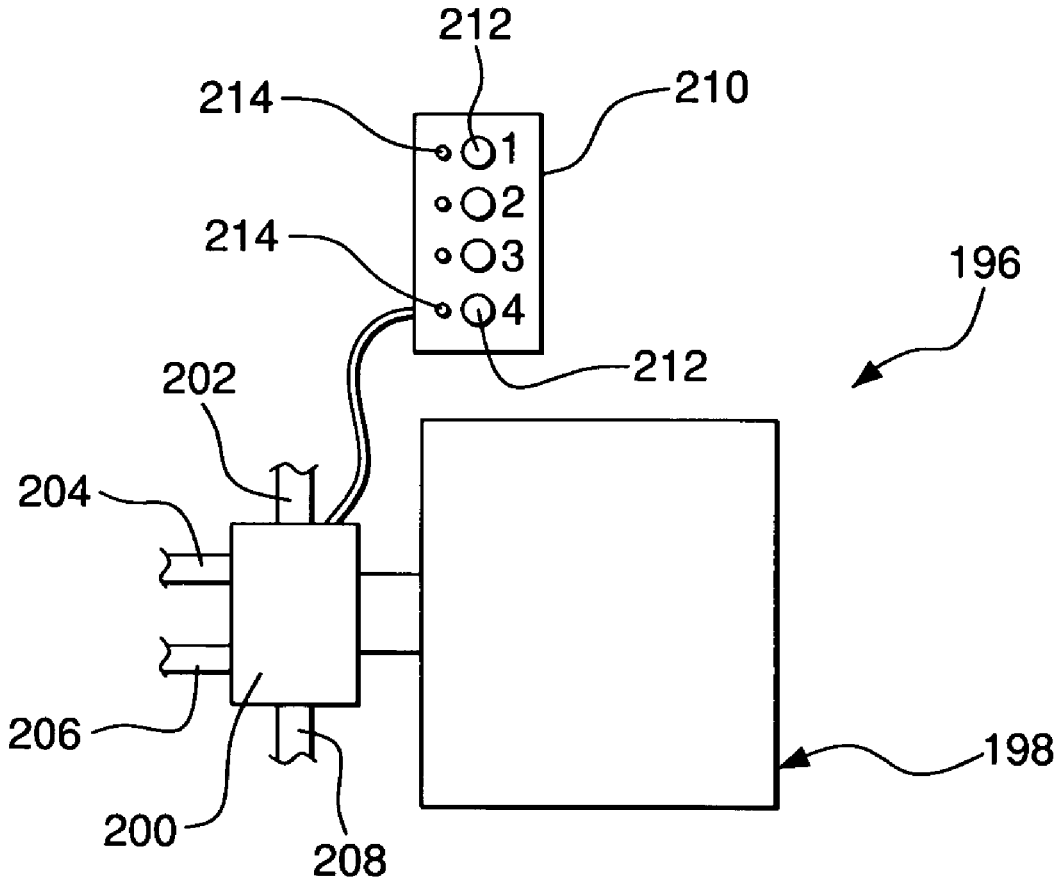
FIG. 11 is a schematic illustration of a pulsating pressure control system.

Referring to FIG. 11, there is illustrated a pulsating pressure system 196 adapted for use with an inflatable incline device, such as device 88 of FIG. 4. The pulsating pressure system 196 includes an air supply 198. Preferably, the air supply 198 comprises an air pump. However, any suitable source of air could alternatively be used. The pulsating pressure system 196 includes a regulator 200 connected to the air supply 198 to receive air from the air supply 198. The regulator 200 of the pulsating pressure system 196 is adapted to transmit pulses of air to an inflatable air chamber. As understood by those skilled in the art, the pulsing of air delivered to an inflatable chamber in this manner provides desirable therapeutic benefits for a patient supported atop such a chamber by promoting skin integrity and patient comfort. The therapeutic benefits associated with delivery of pulsed air to an inflatable chamber of a patient support device are well known and no further description is required.

The depicted regulator 200 of pulsating pressure system 196 includes four outlets 202, 204, 206, 208 for respectively delivering air from the air supply 198 to first, second, third and fourth air chambers of an incline device. Although four outlets are shown, the invention is not so limited and the regulator 200 could be modified as desired to include more (or fewer) outlets than the four that are shown. Preferably, the regulator 200 is adapted such that either pulsed air or non-pulsed air can be directed by the regulator into each of the outlets 202, 204, 206, 208 to inflate an associated inflatable component or removed from the outlets for deflation. In this manner, the air delivered to a plurality of chambers connected to the regulator 200 can be pulsed in any combination of the chambers. For example, the pulsating pressure system 196 could be attached to the inflatable incline device 88 of FIG. 4 such that separate chambers respectively defined by the incline ramp 90, the spinal support 92, the head support pillow 98, and the pad 106 are pulsed by the pulsating pressure system 196 in any combination. It should be understood that the system 196 could be adapted to include one or more additional outlets for delivering air to additional chambers such as the transfer device 112 of FIG. 4 for example.

The pulsating pressure system 196 includes a control unit 210 connected to the regulator 200 to control the distribution of air to the outlets 202, 204, 206, 208. The control unit 210 includes four buttons 212 respectively labeled 1 through 4 to respectively identify the outlets 202, 204, 206, 208. Preferably, the buttons 212 operate in an on/off manner to alternately enable passage of air pulses to the associated chamber or prevent passage of the air pulses. Next to each button 212, the control unit 210 includes a light (e.g., an LED) 214 to indicate whether the associated outlet is in the enabled ("ON") state or disabled ("OFF") state. The lights 214 readily identify to the user which of the chambers are receiving air pulses from the pulsating pressure system 196.

Figure 12:
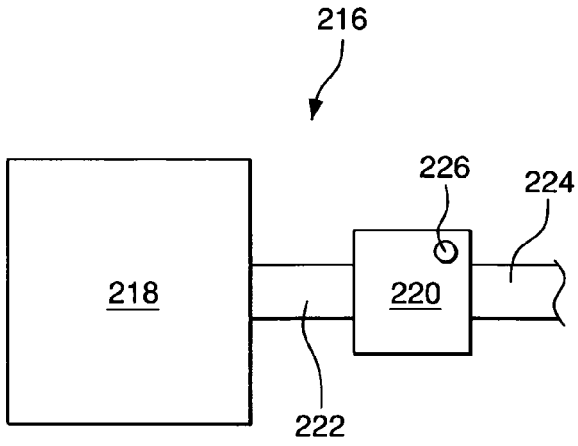
FIG. 12 is a schematic illustration of an air supply system including a heating device in-line with a pressurized air source.

Referring to FIG. 12, there is shown an air supply system 216 for inflating an inflatable device such as any of the above-described patient incline devices. The air supply system 216 includes a source of air (e.g., a pump) 218 adapted to provide pressurized air for deliver to the inflatable chambers of one of the above-described patient incline devices. The air supply system 216 also includes a heating device 220. As shown, the heating device 220 receives pressurized air from the air source 218 via air line (or conduit) 222 and is adapted to heat the pressurized air to raise the temperature of the pressurized air. Preferably, the temperature of the heated air is slightly warmer than normal body temperature (e.g., approximately 100-105 degrees Fahrenheit). Such slightly warmed air facilitates patient comfort by limiting heat transfer from the patient, for example for a patient supported on an incline device during a medical (e.g., bariatric) procedure. The actual temperature of the heated air, however, is not critical and could vary from this range. As shown, the heating device 220 is configured in system 216 as an in-line device with the heated air being discharged from the heating device 220 via air line 224 for delivery to the inflatable device such as the above-described patient incline devices. As should be understood, a manifold system could be connected to the discharge line 224 downstream of the heating device 220 for splitting the supplied air into separate lines for delivery to multiple inflatable chambers.

The heating device 220 preferably includes a button (or switch) 226 for selectively turning the heating device 220 on and off. This desirably provides for the delivery of either heated air or non-heated air from the air supply system 216 at the option of a care-giver or other operator.

The patient incline device of the present invention could, alternatively, be adapted to provide for the cooling of a supported patient. Patient cooling could be facilitated by supplying small ventilation openings in one or more upper surfaces of the patient incline device on which a patient is received. Ventilating air holes provided in upper surfaces of inflatable patient support devices are well known and, therefore, no further description is necessary. As should be understood, any inflatable component of a patient incline device according to the present invention could be adapted to include ventilating air holes in an upper surface such as the incline ramp, the centerline support and the base pad, for example. As should also be understood, the cooling feature for the ventilating openings results from the flow of air directed from the ventilating openings to the patient and does not require that the air be chilled.

Figure 13:
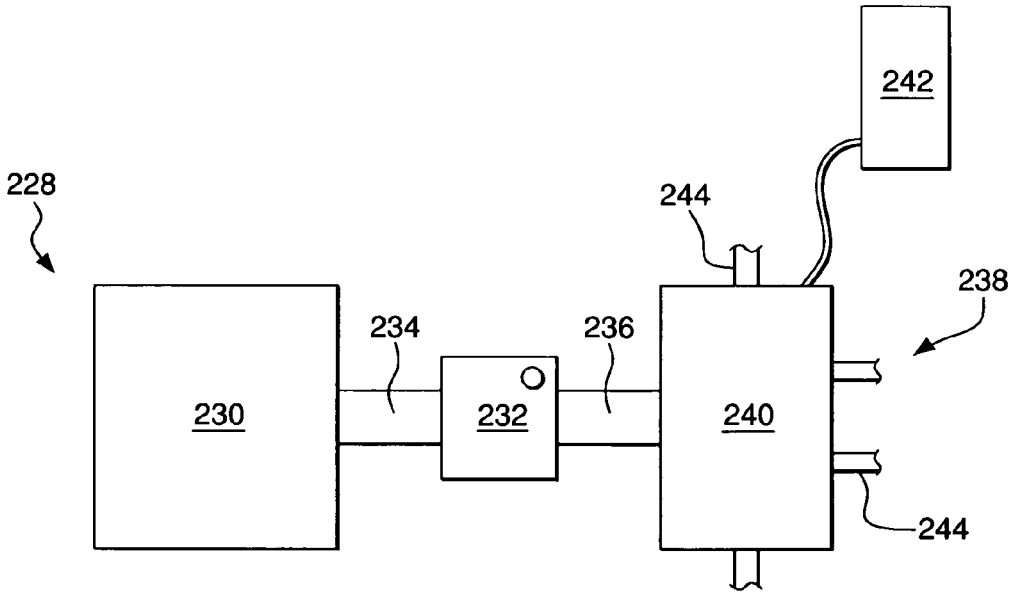
FIG. 13 is a schematic illustration of an air supply system including a source of pressurized air, a heating device and a pulsating pressure system.

Referring to FIG. 13, there is shown an air supply system 228 according to another exemplary embodiment. Similar to air supply 216, the air supply 228 includes an air source (e.g., pump) 230 for providing a supply of pressurized air to an inflatable device such as the above-described patient incline devices. The air supply system 228 also includes a heating device 232 connected to the air source 230 in an in-line manner by an inlet and discharge air lines 234, 236. Similar to heating device 220 of supply system 216, the heating device 232 preferably delivers pressurized air that is heated to a temperature slightly warmer than normal body temperature to facilitate the comfort of a patient supported on an inflated device by limiting loss of body heat from the patient.

The air supply system 228 includes a pulsating pressure system 238 connected to the discharge line 236 for receiving pressurized air from the heating device 232. Similar to the above-described pulsating pressure system 196, the pulsating pressure system 238 includes a regulator 240 and a controller 242 for selectively delivering pulsating pressurized air via lines 244.

Figure 14:
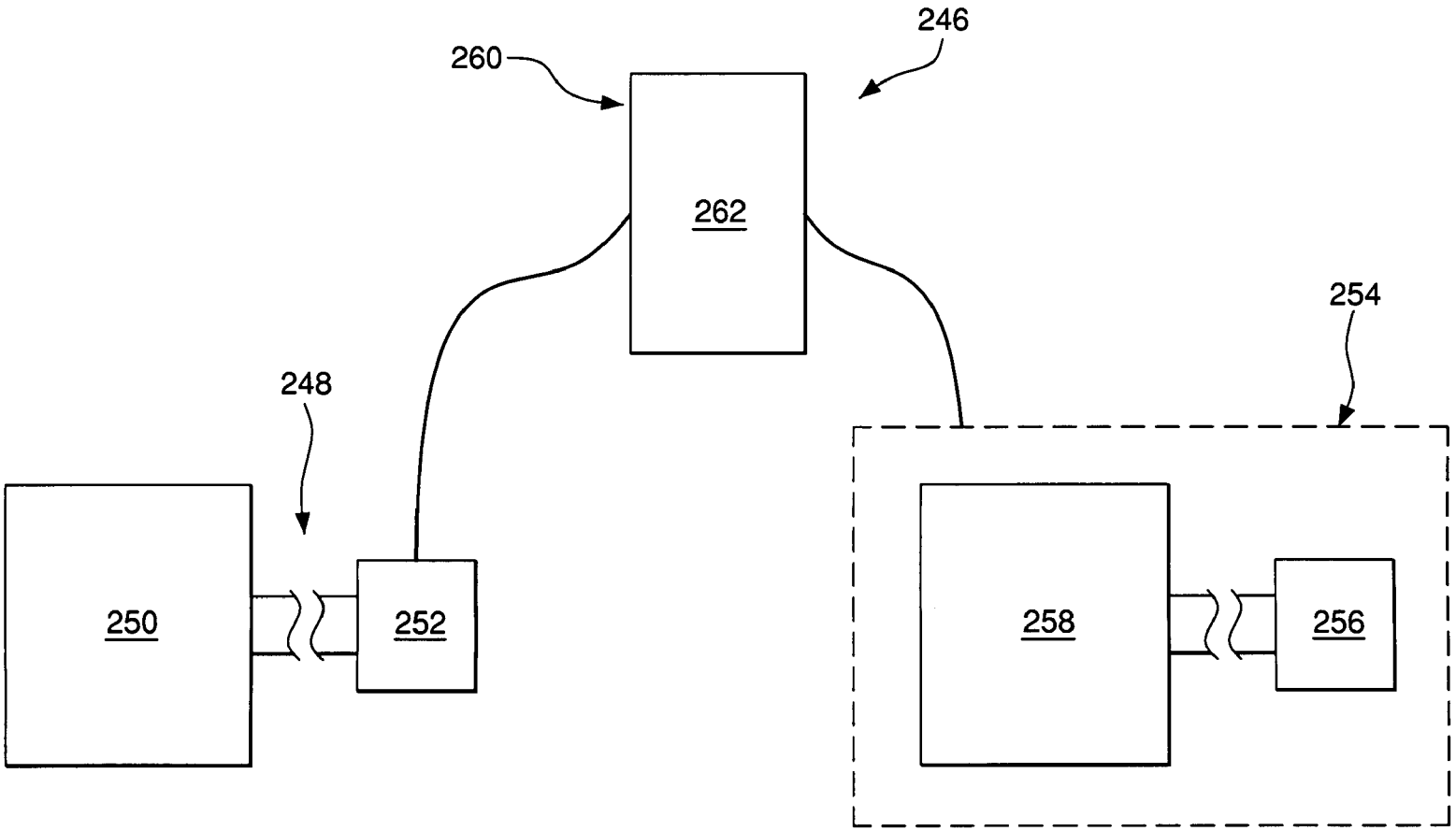
FIG. 14 is a schematic illustration of a ventilation/inflation system including a ventilation system, a patient incline system, and a controller adapted to control the operation patient incline system in response to changes in ventilation gas delivered to a patient from the ventilation system.

Referring to FIG. 14, there is shown schematically a patient ventilation/incline system 246 according to the present invention. The system 246 includes a patient ventilator 248 having a ventilator unit 250 providing a supply of a ventilation gas (e.g., oxygen) and a regulator 252. The regulator 252 is adapted to control the delivery of the ventilation gas from the ventilator unit 250 to a patient (e.g., via a ventilator mask) depending on the needs of the patient. Such ventilators providing demand-type regulation of the ventilation gas to a patient are well known and no further description is required.

The ventilation/incline system 246 includes a patient incline system 254. The incline system 254 includes a patient incline device 256 and an air supply 258. The incline device 256 could embody one of the above-described incline devices but is not so limited. For example, the incline device could be a device such as shown in FIG. 8 of U.S. Publication No. 2005/0193496. As disclosed in the publication, the incline device includes an incline ramp and a head support pillow and an inflation control system that is adapted to separately control the inflation of the head pillow and the incline ramp. Such separate control of the inflation provides for a fine-tuning of the position of the patient's head and torso that is desirable, for example, to achieve an optimum "sniffing position" that facilitates an intubation procedure. The disclosure of U.S. Publication No. 2005/0193496 is incorporated herein in its entirety.

The ventilation/incline system 246 includes a control system 260 including a controller 262 for controlling the inflation of one or more inflatable chamber of the incline device 256 depending on the operation of the ventilator 248. As shown, the controller 262 is connected to the regulator 252 of the ventilator 248. The controller 262 is adapted to receive a signal from the regulator 252 representing the rate at which the ventilating gas is being delivered to the patient from the ventilator 248, thereby monitoring the patient's breathing rate. As shown, the controller 262 is also connected to the incline system 254. The controller 262 is adapted, preferably by means of an algorithm of the controller 262 to direct the incline system 254 to adjust the position of the patient in response to monitored changes in the patient's breathing.

For example, an obese patient receiving ventilating gas from the ventilation system 248 may initially be placed onto the incline device 256 in a substantially flat, supine, condition. Over time, the breathing of the patient may become labored with the patient remaining in the fully supine position. Preferably, the controller 262 is programmed to direct the air supply 258 of the incline system 254 to vary the position of the patient by varying the inflation of the incline ramp of the incline device, thereby elevating the upper torso of the patient from the fully supine position. As discussed above, the inclining of the patient from the fully supine position facilitates easier breathing, particularly for obese patients.

Preferably, the incline system 254 is adapted to provide for both a controlled inflation of the incline device 256 and a controlled deflation of the incline device 256 in response to control signals from the controller 262. In this manner, the controller 262 of the control system 260 could, for example, direct the incline system 254 to deflate (or partially deflate) the incline device 256 in addition to controlling the inflation of the device as described above. In this manner, the controller 262 could be programmed to direct the incline system 254 to deflate the incline device 256 to return the patient to the fully supine position if the monitored breathing rate of the patient drops back down below a preset level.

One exemplary application of the ventilation/incline system 246 is for patient's suffering from sleep apnea. The control system 260 could be adapted to provide a cyclic type of incline control in which the incline system 254 is directed to incline the patient when monitored breathing rate exceeds a preset level and to return (i.e., decline) the patient when the breathing rate drops back down below the preset level to a more normal (i.e., non-labored) level.

The control system of the present invention is not limited in application to adjustment of a patient between a fully supine condition and an inclined condition. The control system could be adapted to provide for graduated adjustments in the inclined position of the patient in response to monitored changes in the patient's breathing. The control system is also not limited to control of inflation for the purpose of adjusting the inflation of the incline ramp and could also be used to control other inflatable features such as the spinal support provided by the spinal support described above. It might be desirable, for example, to control the inflation of the spinal support to adjust the amount of support provided to a patient.

It is not a requirement of the invention that the controller 262 of the control system 260 is hard wired to the ventilation system 248 and the incline system 254 as depicted in FIG. 14. It is conceivable for example that other means (e.g., wireless, infrared, etc.) could be utilized to transmit signals between the controller 262 and the ventilation and incline systems 248, 254.

The foregoing describes the invention in terms of embodiments preferred by the inventor for which an enabling description was available, notwithstanding that insubstantial modifications of the invention, including those not presently foreseen, may nonetheless represent equivalents thereto.

What is claimed is:

1. A patient incline device comprising:

a base member;

an inflatable incline ramp located on an upper surface of the base member, the incline ramp adapted to support a patient such that the patient's upper torso is elevated with respect to the base member; and a wedge-shaped inflatable spinal support air chamber located on the incline ramp and angling upward in a direction away from the incline ramp, and aligned with a centerline of the incline ramp, wherein a peak end of the wedge extends to the region of about the patient's lumbar curve.

2. A patient incline device according to claim 1, further comprising:

an inflatable head support pillow located on the incline ramp for supporting the patient's head, and wherein the edge of the wedge-shaped spinal support air chamber that is opposite the peak is located near a lower edge of the incline ramp.

3. A patient incline device according to claim 1, further comprising a pop-up air chamber located on the wedge-shaped spinal support chamber and having internal air vents to the spinal support chamber such that when the spinal support chamber inflates, the pop-up chamber will rise as pressure accumulates and lift a thoracic curve portion of the patient's spine.

4. A patient incline device according to claim 2, further comprising a pop-up air chamber located on the wedge-shaped spinal support chamber and having internal air vents to the spinal support chamber such that when the spinal support chamber inflates, the pop-up chamber will rise as pressure accumulates and lift a thoracic curve portion of the patient's spine.

5. A patient incline device according to claim 4 wherein the wedge-shaped spinal support chamber has a width that is less than a width of the incline ramp, such that lateral spaces are defined on the incline ramp along each of opposite sides of the spinal support for receiving the arms and side portions of the patient's torso to expand the chest wall of the patient.

6. A patient incline device according to claim 5, wherein the base member includes an inflatable pad.

7. A patient incline device according to claim 6, wherein the incline ramp and the wedge-shaped spinal support air chamber are removably attached to the inflatable pad base member.

8. A patient incline device according to claim 6, in combination with an accessory lift device, the accessory lift device comprising:

an inflatable air chamber having side lobes adapted to lie along each lateral side of the inflatable pad base member and a seat portion that crosses transversely over the pad in the area of the patient's buttocks.

9. A patient incline device according to claim 8 herein the accessory lift device is removably attached to the incline device by fasteners.

10. A patient incline device according to claim 9, wherein the inflatable pad base member is a transfer pad having holes in a bottom surface for creating a weight-bearing cushion of escaping air beneath the incline device to facilitate sliding of the base pad on an underlying support surface.

* * * * *

UNITED STATES PATENT AND TRADEMARK OFFICE

CERTIFICATE OF CORRECTION

PATENT NO. : 7,681,262 B2
APPLICATION NO. : 12/316685
DATED : March 23, 2010
INVENTOR(S) : Robert E. Weedling and James E. Weedling It is certified that error appears in the above-identified patent and that said Letters Patent is hereby corrected as shown below:

On the Title Pg, Item (60), under "Related U.S. Application Data" should read:

Provisional application No. 60/855,874, filed on Nov. 1, 2006, provisional application No. 60/860,044, filed on Nov. 20, 2006.

Under column 1, first paragraph, should read:

This application is a continuation-in-part of U.S. application Ser. No. 11/732,184 filed Apr. 3, 2007 and issued as U.S. Pat. No. 7,467,431, which claims priority of U.S. Provisional Application No. 60/855,874, filed Nov. 1, 2006 and U.S. Provisional Application No. 60/860,044 filed Nov. 20, 2006. Priority is claimed herein for the subject matter disclosed in those earlier filed applications.

Signed and Sealed this
Thirtieth Day of August, 2011

David J. Kappos

David J. Kappos
*Director of the United States Patent and Trademark Office*